United States Patent [19]

Sugimoto et al.

[11] 4,407,937

[45] Oct. 4, 1983

[54] SILVER HALIDE PHOTOGRAPHIC SENSITIVE ELEMENT CONTAINING A FLUORINE CONTAINING COMPOUND AS AN ANTISTATIC AGENT

[75] Inventors: Naohiko Sugimoto; Yukio Maekawa; Yasunori Ichikawa, all of Minami-ashigara, Japan

[73] Assignee: Fuji Photo Film Co., Ltd., Kanagawa, Japan

[21] Appl. No.: 354,677

[22] Filed: Mar. 4, 1982

[30] Foreign Application Priority Data

Mar. 4, 1981 [JP] Japan ..... 56/30293

[51] Int. Cl.[3] ..... G03C 1/78

[52] U.S. Cl. ..... 430/527; 430/631

[58] Field of Search ..... 430/518, 527, 631

[56] References Cited

U.S. PATENT DOCUMENTS

| | | | |
|---|---|---|---|
| 3,847,838 | 11/1974 | Habu et al. | 430/527 |
| 4,013,696 | 3/1977 | Babbitt et al. | 430/527 |
| 4,201,586 | 5/1980 | Hori et al. | 430/631 |
| 4,242,444 | 12/1980 | Habu et al. | 430/527 |

*Primary Examiner*—Jack P. Brammer

*Attorney, Agent, or Firm*—Sughrue, Mion, Zinn, Macpeak & Seas

[57] ABSTRACT

A silver halide photographic sensitive material is described comprising a compound represented by formula (I)

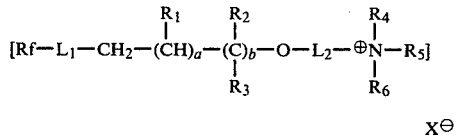

(I)

wherein Rf represents a saturated or unsaturated hydrocarbon group having from 3 to 20 carbon atoms wherein all or a part of the hydrogen atoms are substituted by fluorine atoms, each of $L_1$ and $L_2$ represents a divalent linking group, each of $R_1$, $R_2$, and $R_3$ represents a hydrogen atom, a methyl group, or an ethyl group, each of $R_4$, $R_5$, and $R_6$ represents an alkyl group having from 1 to 6 carbon atoms, X represents an anion, and each of a and b represents 0, 1, or 2.

6 Claims, No Drawings

SILVER HALIDE PHOTOGRAPHIC SENSITIVE ELEMENT CONTAINING A FLUORINE CONTAINING COMPOUND AS AN ANTISTATIC AGENT

FIELD OF THE INVENTION

The present invention relates to silver halide photographic sensitive materials (hereinafter referred to simply as "photographic sensitive materials"), and particularly to photographic sensitive materials having an improved antistatic property and improved coating ability.

BACKGROUND OF THE INVENTION

Since photographic sensitive materials are generally composed of an electrically insulating base and photographic layers, static charges are frequently accumulated when the materials are subjected to friction or separation caused by contacting with the surface of the same or different materials during steps for production of the photographic sensitive materials or in the case of using them for photographic purposes. These accumulated static charges cause many problems. The most serious problem is discharge of accumulated static charges prior to development processing, by which the sensitive emulsion layer is exposed to light to form dot spots or branched or feathery linear specks when development of the photographic films is carried out. This phenomenon is the so-called static mark, by which a commercial value of the photographic films significantly deteriorates, and is sometimes entirely lost. For example, in the case of medical or industrial X-ray films, it is easily understood that the static marks may result in a very dangerous judgement or misdiagnosis. This phenomenon is a very troublesome problem, because it becomes clear for the first time by carrying out development. Further, these accumulated static charges are also the origin of secondary problems such as adhesion of dusts to the surface of films, uneven coating, etc.

As described above, such static charges are frequently accumulated in the cases of producing and using photographic sensitive materials. For example, in the step for production, they are generated by friction of the photographic film contacting a roller or by separation of the emulsion face from the base face during a step for rolling or unrolling. Further, they are generated on X-ray films in an automatic camera by contacting with or separating from mechanical parts or fluorescent sensitizing paper, or they are generated by contact with or separation from rollers and bars made of rubber, metal, or plastics in a bonding machine or an automatic developing machine in the developing shop or in a camera in the case of using color negative films or color reversal films. In addition, they are generated by contact with packing materials, etc.

Static marks on photographic sensitive materials occurring due to accumulation and discharge of static charges increase with increases in the sensitivity of the photographic sensitive materials and an increase of the processing speed. Particularly, static marks are easily generated because of high sensitization of the photographic sensitive materials and severe processing conditions such as high speed coating, high speed photographing, and high speed automatic treatment.

In order to prevent these troubles caused by static charges, it is suitable to add antistatic agents to the photographic sensitive materials. However, antistatic agents used conventionally in other fields cannot be used freely for photographic sensitive materials, because they are subjected to various specific restrictions due to the nature of the photographic sensitive materials. Namely, it is required for the antistatic agents capable of use in the photographic sensitive materials that not only is the antistatic ability excellent, but also that they do not have adverse influences upon photographic properties of the photographic sensitive materials, such as sensitivity, fog, granularity, sharpness, etc., that they do not have an adverse influence upon film strength of the photographic sensitive materials (namely, that the photographic sensitive materials are not easily injured by friction or scratching), that they do not have an adverse influence upon adhesion resistance (namely, that the photographic sensitive materials do not easily adhere when the surfaces of them are brought into contact with each other or with surfaces of other materials), that they do not accelerate deterioration of processing solutions for the photographic sensitive materials, and that they do not deteriorate adhesive strength between layers composing the photographic sensitive materials, etc. Accordingly, applications of antistatic agents to photographic sensitive materials are subject to many restrictions.

One method for overcoming problems caused by static charges comprises increasing electric conductivity of the surface of the photographic sensitive material so that static charges disappear within a short time, prior to spark discharging of the accumulated charges.

Accordingly, processes for improving the electrically conductive property of the base or the surface of various coating layers in the photographic sensitive materials have been proposed hitherto, and utilization of various hygroscopic substances, water-soluble inorganic salts, certain kinds of surfactants and polymers, etc., has been attempted. For example, it has been known to use polymers as described in U.S. Pat. Nos. 2,882,157, 2,972,535, 3,062,785, 3,262,807, 3,514,291, 3,615,531, 3,753,716, 3,938,999, etc., surface active agents as described in U.S. Pat. Nos. 2,982,651, 3,428,456, 3,457,076, 3,454,625, 3,552,972, 3,655,387, etc., and metal oxides and colloidal silica as described in U.S. Pat. Nos. 3,062,700, 3,245,833, 3,525,621, etc.

However, many of these substances exhibit great specificity, depending upon the kind of film base or the photographic composition, and there are cases that, although they produce a good result on certain specific film bases, photographic emulsions or other photographic elements, they are not only useless for preventing generation of static charges in case of using different film bases and photographic elements, but also have an adverse influence upon photographic properties.

On the other hand, there are many cases wherein, although they have excellent antistatic effects, they can not be used because of having an adverse influence upon photographic properties such as sensitivity, fog, granularity, sharpness, ect. For example, it has been well known that polyethylene oxide compounds have antistatic effects, but they often have an adverse influence upon photographic properties, such as increasing fog, desensitization, deterioration of granularity, etc. Particularly, in sensitive materials in which both sides of the base are coated with photographic emulsions, such as medical direct X-ray sensitive materials, it has been difficult to develop techniques for effectively providing an antistatic property without having an adverse influence upon photographic properties. Thus, the application of antistatic agents to the photographic sensitive materials is very difficult, and their use is often limited to a certain range.

Another method for overcoming the problems of photographic sensitive materials caused by static charges is that which comprises controlling the triboelectric series of the surface of the sensitive materials to reduce generation of static charges caused by friction or touching as described above.

For example, it has been attempted to utilize fluorine containing surface active agents, as described in British Pat. Nos. 1,330,356 and 1,524,631, U.S. Pat. Nos. 3,666,478 and 3,589,906, Japanese Patent Publication No. 26687/77 and Japanese Patent Application (OPI) Nos. 46733/74 and 32322/76 (the term "OPI" as used herein refers to a "published unexamined Japanese patent application"), etc., for photographic sensitive materials for the above-described purpose.

However, photographic sensitive materials containing these fluorine containing surface active agents generally have an electrostatic property of charging in negative polarity. Accordingly, although it is possible to adapt the triboelectric series of the surface of the sensitive materials for each triboelectric series of rubber rollers, Delrin (linear polyoxymethylene type acetal resin) rollers and nylon rollers by suitably combining the fluorine containing surface active agents (having an electrostatic property of charging in negative polarity) with a non-fluorine type surface active agents having an electrostatic property of charging in positive polarity, problems still occur, because the triboelectric series of the surface of the sensitive materials cannot be simultaneously adapted for all triboelectric series of rubber rollers, Delrin rollers and nylon rollers. That is, when such prior fluorine containing surface active agents are used so as to adapt for rubber, branched static marks occur due to Delrin, of which triboelectric series is situated on the positive side comparing to the triboelectric series of rubber; and when they are used so as to adapt for Delrin, spot static marks occur due to the rubber, of which triboelectric series is situated on the negative side comparing to the triboelectric series of Delrin.

For the purpose of compensating for this fault, there are processes which comprise reducing the surface resistance by using high molecular electrolytes together therewith. However, they also produce adverse effect; for example, they cause deterioration of adhesion resistance and have an adverse influence upon photographic properties. Accordingly, it is impossible to incorporate them so as to provide a sufficient antistatic property.

Furthermore, it is well known that the photographic sensitive materials are prepared by applying a subbing layer, silver halide photographic emulsion layers, a protective layer, a filter layer, an antihalation layer and an intermediate layer, etc., to a base composed of cellulose acetate, polyester, or polyethylene laminated paper, etc. In the case of producing photographic sensitive materials having such many layers, it is required to apply coating solutions so as to form a uniform thin layer without causing problems such as "relelling" (i.e., a very small spot which is uncoated with a coating solution), etc. Furthermore, in the case of producing photographic sensitive materials, sometimes the photographic emulsions and other gelatin containing coating solutions are applied to the base at the same time to form a multilayer structure. For example, in order to produce a color photographic sensitive material, three or four photographic emulsion layers are formed simultaneously by continuous application. In the case of applying gelatin or another colloid solution to such a gelatin colloid layer, it is very difficult to obtain coating properties required for such a case as compared with the case of applying the gelatin colloid solution directly to the base. It is particularly difficult in the case wherein the layer to be applied is a wet layer set by cooling just after application. Hitherto, although many fluorine containing surface active agents have been used as antistatic agents, most of them have inferior coating ability, particularly in high speed applications, and they cause formation of "comets" or "repelling", i.e., local imperfect coating caused by dusts and unevenness.

U.S. Pat. No. 4,013,696 has disclosed an art wherein nonionic surface active agents are used together. However, this art is useful only for specified photographic coating solutions or under specified coating conditions, and lacks wide applicability.

SUMMARY OF THE INVENTION

A first object of the present invention is to provide antistatic photographic sensitive materials which are less subject to generate static electricity.

A second object of the present invention is to provide photographic sensitive materials capable of forming a homogeneous suspension in the case of applying a photographic coating solution containing various photographic binders, such as gelatin, at a high speed to form a thin layer, and obtaining a uniform coating layer without causing problems such as "repelling", "comet", etc.

A third object of the present invention is to provide photographic sensitive materials having improved coating properties such as prevention of repelling, etc., for which can be easily applied second and third gelatin-containing layers to a gelatin containing photographic layer by means of plural coating machines or in the case of applying them to a subbing layer at the same time to form a multilayer construction.

These objects of the present invention have been attained by providing silver halide photographic sensitive materials which comprise a compound represented by formula (I)

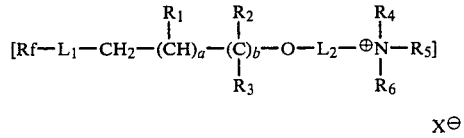

(I)

wherein Rf represents a saturated or unsaturated hydrocarbon group having from 3 to 20 carbon atoms wherein all or a part of the hydrogen atoms are substituted by fluorine atoms, each of $L_1$ and $L_2$ represents a divalent linking group, each of $R_1$, $R_2$, and $R_3$ represents a hydrogen atom, a methyl group, or an ethyl group, each of $R_4$, $R_5$, and $R_6$ represents an alkyl group having from 1 to 6 carbon atoms, X represents an anion, and each of a and b represents 0, 1, or 2.

DETAILED DESCRIPTION OF THE INVENTION

Rf preferably represents a saturated or unsaturated hydrocarbon group having from 3 to 20 carbon atoms wherein all or all but one hydrogen atoms are substituted by fluorine atoms.

Examples of the divalent group represented by $L_1$ in formula (I) include the groups

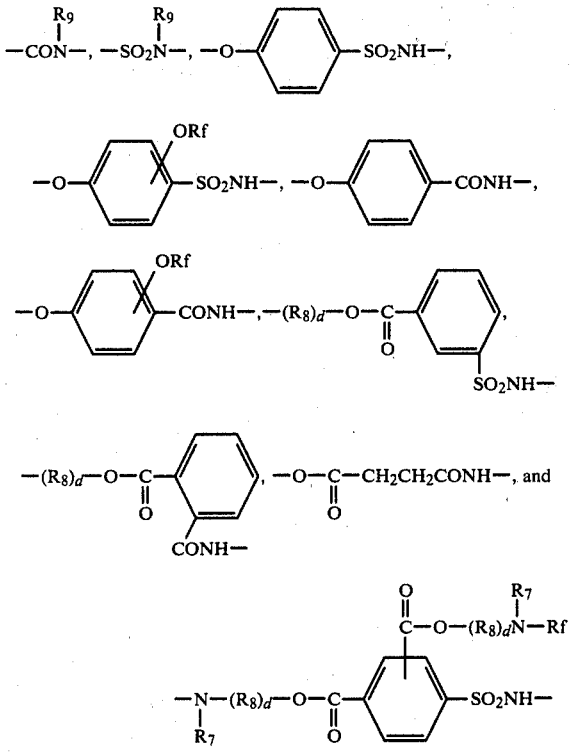

wherein Rf represents the same meaning as described above, $R_7$ represents a hydrogen atom, or a methyl group, $R_8$ represents an alkylene group (having from 1 to 5 carbon atoms), d represents 0 to 1, and $R_9$ represents a hydrogen atom or an alkyl group having from 1 to 12 carbon atoms.

Examples of the divalent group represented by $L_2$ include the groups

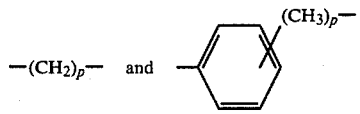

wherein p represents an integer of 1 to 4.

Examples of X in formula (I) include the anions

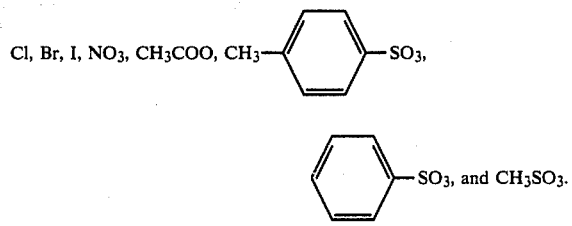

Examples of typical compounds used according to the present invention are described as follows:

1.

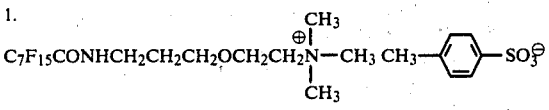

2.

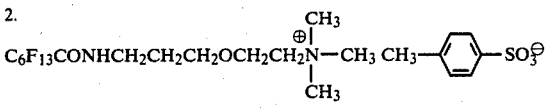

3.

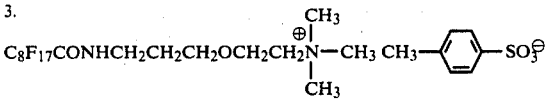

4.

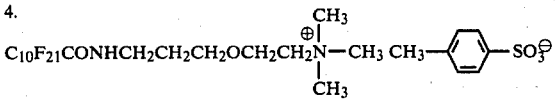

5.

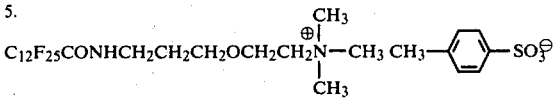

6.

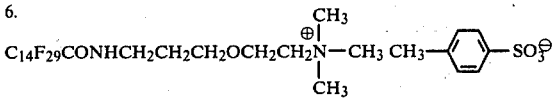

7.

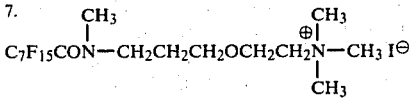

8.

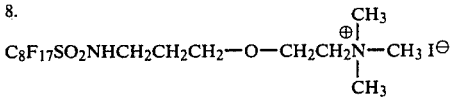

9.

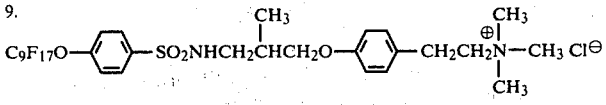

10.

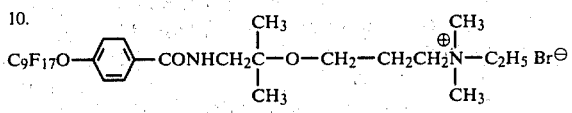

-continued

11.

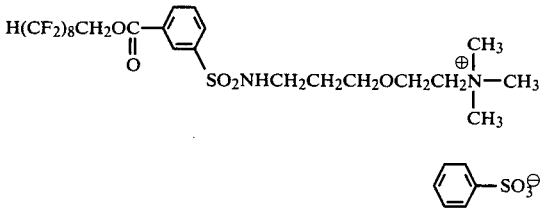

12.

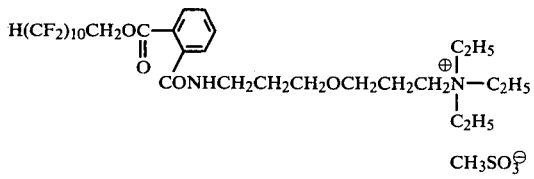

13.

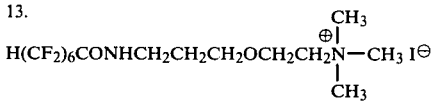

14.

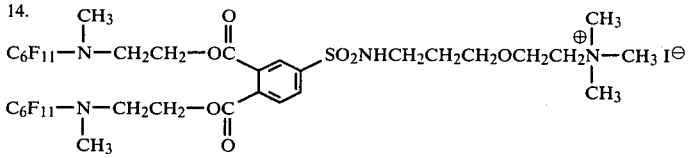

15.

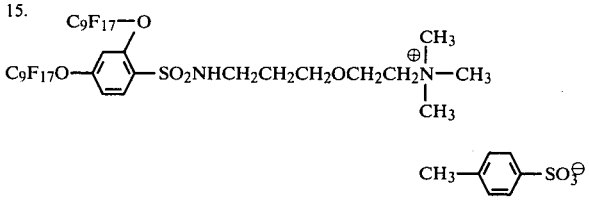

These compounds may be used alone or they may be used as a mixture of two or more compounds.

These compounds can be obtained by a process which comprises reacting alcohol or phenol having a tertiary amino group represented by formula (II) below with nitrile having an unsaturated group represented by formula (III) below or a compound having a nitro group represented by formula (IV) below to form a compound represented by formulae (V) or (VI) below, reducing the nitrile group or the nitro group to convert it into an aminomethyl group or an amino group, and thereafter reacting the resulting compound with a saturated or unsaturated hydrocarbon having a carboxylic, sulfonic, or phosphoric acid chloride group in which all or a part of the hydrogen atoms are substituted by fluorine atoms, and thereafter quaternarizing the tertiary amino group.

Formula (II) can be represented as

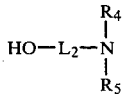

(II)

wherein each of $L_2$, $R_4$, and $R_5$ has the same meaning as defined for formula (I).

Formula (III) can be represented as

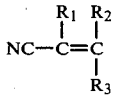

(III)

and formula (IV) can be represented as

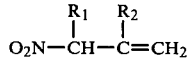

(IV)

wherein each of $R_1$, $R_2$, and $R_3$ has the same meaning as defined for formula (I).

Formulae (V) and (VI) can be represented as

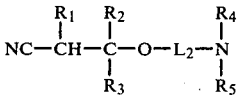

(V)

and

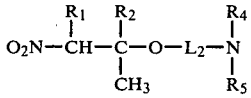

(VI)

respectively, wherein each of $R_1$, $R_2$, $R_3$, $R_4$, $R_5$, and $L_2$ has the same meaning as defined for formula (I).

In the following, examples of the process for synthesizing the compounds used according to the present invention are described.

SYNTHESIS 1

Synthesis of Compound 1

Step 1: Synthesis of 2-(3'-perfluorooctaamidopropyl-)oxy-N,N-dimethyl-ethylamine 87.6 g (10.6 mols) of 3-(2'-N,N-dimethylaminoethyloxy)propylamine synthesized from N,N-dimethylethanolamine and acrylonitrile according to the conventional process (for example, F. C. Whitmore et al., *J. Am. Chem. Soc.*, Vol. 66, 725 (1944)) and 247 g of acetonitrile were placed in a 1-liter three-neck flask equipped with a condenser and kept at 40° C. with stirring. To the mixture, 216 g (10.5 mols) of perfluorooctanoyl chloride synthesized by a conventional process was added dropwise. After conclusion of the addition, the temperature was raised to 60° C. After stirring was continued for 4 hours, the mixture was allowed to stand overnight to cool. A solution composed of 20 g (0.5 mol) of sodium hydroxide and 250 ml of water was added to the mixture. After stirring, the aqueous layer was separated, and 250 ml of a 5% aqueous solution of common salt (NaCl) was added to the oily layer, followed by stirring. After separating the aqueous layer, the oily layer was subjected to vacuum distillation to obtain 244 g (yield: 90%) of the desired intermediate compound having a boiling point of 115° to 122° C./1 mmHg.

Step 2: Synthesis of Compound 1

217 g (10.4 mols) of the 2-(3'-perfluorooctaamidopropyl)oxy-N,N-dimethyl-ethylamine resulting from step 1 and 1.5 liters of ethyl acetate were placed in a 3 liter three neck flask equipped with a condenser and kept at room temperature. While stirring the mixture, 82 g (10.44 mols) of methyl p-toluenesulfonate was added dropwise over 30 minutes. After conclusion of the addition, the reaction was carried out at room temperature for 5 hours with stirring.

After cooling with ice, the precipitated crystals were separated by filtration and dried overnight in air.

To the crystals, a solution composed of 1 liter of ethyl acetate and 500 ml of acetone was added and heated to dissolve the crystals. After separating insoluble materials by filtration in a hot state, the solution was cooled, and the precipitated crystals were separated by filtration and dried in vacuum at 60° C. for 5 hours to obtain 224 g (yield: 77%) of Compound 1.

SYNTHESIS 2

Synthesis of Compound 7

136 g (0.25 mol) of 2-(3'-perfluorooctaamidopropyloxy)-N,N-dimethyl-ethylamine obtained in Synthesis 1 and 500 ml of ethyl acetate were placed in a 1 liter three-neck flask equipped with a condenser, and the mixture was stirred while maintaining it at 40° C. or less. 71 g (0.5 mol) of methyl iodide was added dropwise thereto over 1 hour. After conclusion of the addition, the temperature was raised and stirring was continued for 4 hours with refluxing.

After cooling with ice, the precipitated white crystals were separated by filtration. After drying overnight in air, they were dissolved in 500 ml of methanol with heating. Reprecipitation was carried out using 3 liters of ethyl acetate, and the precipitated white crystals were separated by filtration and dried in vacuum at 60° C. for 5 hours to obtain 152 g (yield: 88.8%) of Compound 7.

The compounds of the present invention are added to at least one layer of layers comprising the photographic sensitive materials. It is preferred to add to layers other than silver halide emulsion layers, for example, a surface protective layer, a back layer, an intermediate layer, or a subbing layer, etc. In the case that the back layer consists of two layers, the compounds may be added to any of them. Furthermore, they may be applied as an overcoating on the surface protective layer.

In order to obtain the best effect of the present invention, it is preferred to add the compounds of the invention to the surface protective layer, the back layer, or the overcoating layer.

In the case of applying the compound according to the present invention to the photographic sensitive material, the compounds are dissolved in water, an organic solvent such as methanol, isopropanol, or acetone, etc., or a mixture thereof, and the resulting solution is added to a coating solution for the surface protective layer or the back layer etc. Then, the coating solution is applied by a dip coating method, an airknife coating method, or an extrusion coating method using a hopper as described in U.S. Pat. No. 2,681,294, or by a method described in U.S. Pat. Nos. 3,508,947, 2,941,898 and 3,526,528, etc., by which two or more layers are applied at the same time, or the photographic sensitive material is dipped in the antistatic solution. Further, if desired, the antistatic solution containing the compounds of the present invention can be additionally applied onto the protective layer.

It is preferred that an amount of the compounds according to the present invention be from 0.0001 to 2.0 g, and preferably from 0.0005 to 0.5 g, per square meter of the photographic sensitive material.

However, the above-described amount can vary according to the particular kind of photographic film base to be used, the photographic composition, and the form and method of coating.

Examples of the base for the photographic sensitive materials of the present invention include cellulose nitrate films, cellulose acetate films, cellulose acetate butyrate films, cellulose acetate propionate films, polystyrene films, polyethylene terephthalate films, polycarbonate films and laminates of them, etc. In more detail, it is possible to use papers coated or laminated with baryta or α-olefin polymers, and particularly polymers of α-olefin having from 2 to 10 carbon atoms such as polyethylene, polypropylene, ethylene-butene copolymer, etc.

In the photographic sensitive materials of the present invention, each photographic layers can contain binder. Examples of useful binders include as hydrophilic colloids proteins such as gelatin, colloidal albumin, casein, etc.; cellulose compounds such as carboxymethyl cellulose, or hydroxyethyl cellulose, etc.; saccharides such as agar, sodium alginate or starch derivatives, etc.; and synthetic hydrophilic colloids, for example, polyvinyl alcohol, poly-N-vinylpyrrolidone, polyacrylic acid copolymer, polyacrylamide, derivatives thereof, partially hydrolyzed products thereof, etc. If desired, these colloids can be used as a mixture of two or more thereof.

Among them, gelatin is the most suitable. "Gelatin" as used herein means the so-called lime treated gelatin, acid treated gelatin, and enzyme treated gelatin. A part or the whole of the gelatin can be replaced by synthetic polymeric materials. Further, it may be replaced by gelatin derivatives, such as derivatives obtained by treating or modifying amino groups, imino groups, hydroxy groups, or carboxyl groups contained in the gelatin molecule as functional groups with a reagent having a group capable of reacting therewith or graft polymers obtained by bonding thereto a polymeric material.

Silver halide emulsions for the photographic sensitive materials used in the present invention are generally produced by blending a solution of water-soluble silver salts (for example, silver nitrate) with a solution of water-soluble halides (for example, potassium bromide) in a presence of a solution of water-soluble high molecular materials such as gelatin. As the silver halide, it is possible to use not only silver chloride and silver bromide, but also mixed silver halides such as silver chlorobromide, silver iodobromide, silver chloroiodobromide, etc.

The photographic emulsions can be subjected to spectral sensitization or supersensitization using polymethine sensitizing dyes such as cyanine, merocyanine, carbocyanine, etc., alone or as a combination thereof, or by using such dyes in combination with styryl dyes, etc.

Furthermore, it is possible to add various compounds to the photographic emulsions for the photographic sensitive materials used in the present invention in order to prevent deterioration of sensitivity or the occurrence of fog in the step for production of the sensitive materials, during preservation or during processing. Many such compounds have been known hitherto, examples of which include heterocyclic compounds including 4-hydroxy-6-methyl-1,3,3a,7-tetrazaindene-3-methylbenzothiazole and 1-phenyl-5-mercaptotetrazole, mercury containing compounds, mercapto compounds, metal salts, etc.

In the case of using the silver halide photographic emulsions as color photographic sensitive materials, the silver halide emulsion layers may contain couplers. As such couplers, it is possible to use 4-equivalent diketomethylene yellow couplers, 2-equivalent diketomethylene yellow couplers, 4-equivalent and 2-equivalent pyrazolone magenta couplers, imidazolone magenta couplers, α-naphthol cyan couplers, phenol cyan couplers, etc.

The silver halide emulsion layers and other layers in the photographic sensitive materials of the present invention can be hardened by various organic and inorganic hardening agents (alone or as a combination). Examples thereof include aldehyde compounds such as mucochloric acid, formaldehyde, trimethylolmelamine, glyoxal, 2,3-dihydroxy-1,4-dioxane, 2,3-dihydroxy-5-methyl-1,4-dioxane, succinaldehyde, and glutaraldehyde; active vinyl compounds such as divinyl sulfone, methylenebismaleimide, 1,3,5-triacryloyl-hexahydro-s-triazine, 1,3,5-trivinylsulfonyl-hexahydro-s-triazine, bis(vinylsulfonylmethyl)ether, 1,3-bis(vinylsulfonylmethyl)propanol-2, and bis(α-vinylsulfonylacetamide)ethane; active halogen compounds such as sodium salt of 2,4-dichloro-6-hydroxy-s-triazine and 2,4-dichloro-6-methoxy-s-triazine; and ethyleneimine compounds such as 2,4,6-triethyleneimino-s-triazine, etc.

Surface active agents may be added alone or as a mixture to the photographic layers of the present invention. They may be used as coating assistants, but they can sometimes be used for other purposes, for example, for emulsification or dispersion, sensitization, or improvement of other photographic properties and control of triboelectric series.

These surface active agents are classified into natural surface active agents such as saponin, etc.; nonionic surface active agents such as alkylene oxide type, glycerine type or glycidol type active agents; cationic surface active agents such as higher alkylamines, quaternary ammonium salts, pyridine and other heterocyclic compounds, sulfonium, or phosphonium compounds, etc.; anionic surface active agents containing acid groups such as carboxylic acid, sulfonic acid, phosphoric acid, sulfuric acid ester, or phosphoric acid ester groups, etc.; and ampholytic surface active agents such as amino acids, aminosulfonic acids, or sulfuric or phosphoric acid esters of aminoalcohol, etc.

Some examples of surface active agents capable of using have been described in U.S. Pat. No. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, 3,545,974, 3,666,478 and 3,507,660, British Pat. No. 1,198,450, in Ryohei Oda et al., *Kaimen Kasseizai no Gosei to sono Oyo* (published by Maki Shoten Co., 1964), in A. W. Perry, *Surface Active Agents* (Inter-science Publication Incorporated, 1958), and in J. P. Sisly, *Encyclopedia of active Agents,* Vol. 2 (Chemical Publishing Company, 1964).

In the present invention, fluorine containing surface active agents other than compounds represented by formula (I) of the present invention can also be used. Examples of such fluorine containing surface active agents include the following compounds. For example, there are fluorine containing surface active agents described in British Pat. Nos. 1,330,356 and 1,524,631, U.S. Pat. Nos. 3,666,478 and 3,589,906, Japanese Patent Publication No. 26687/77 and Japanese Patent Application (OPI) Nos. 46733/74 and 32322/76, etc.

Furthermore, the photographic layers may contain a lubricating composition such as modified silicone as described, for example, in U.S. Pat. Nos. 3,079,837, 3,080,317, 3,545,970 and 3,294,537 and Japanese Patent Application (OPI) No. 129520/77.

In the photographic sensitive materials of the present invention, the photographic layers may contain polymer latexes described in U.S. Pat. Nos. 3,411,911 and 3,411,912, and Japanese Patent Publication No. 5331/70, or silica, strontium sulfate, barium sulfate or polymethyl methacrylate, etc., as a matting agent.

The photographic layers in the photographic sensitive materials of the present invention may contain ultraviolet ray absorbing agents such as those described in U.S. Pat. Nos. 3,253,921, 3,707,375, 3,271,156, 3,794,493, 3,698,907 and 4,195,999 and Japanese Patent Application (OPI) No. 56620/76 in a dispersed state.

As was noted above, according to the present invention, problems originating from static charges generating during the steps for production of the photographic sensitive materials and/or in the case of using the sensitive materials can be overcome.

For example, formation of static marks caused by contact of the emulsion face of the photographic sensitive materials with the back face, contact of the emulsion face with another emulsion face, or contact of the emulsion face with materials which frequently contact with the photographic sensitive materials, such as rubber, metal, plastics, fluorescent sensitizing paper, etc., is remarkably reduced by carrying out the present invention.

In the following, the effects of the present invention are illustrated in detail by reference to Examples, but the present invention is not limited thereto.

EXAMPLE 1

To a surface of a polyethylene terephthalate film base having a thickness of about 175μ, an emulsion layer and then a protective layer were applied by a conventional method and dried to form Samples 11 to 15. The composition of each layer was as follows:

Emulsion Layer: about 5μ:

Binder: Gelatin 2.5 g/m$^2$

Silver content coated: 5 g/m$^2$

Composition of silver halide: AgI 1.5 mol% and AgBr 98.5 mol%

Antifogging agent: 1-Phenyl-5-mercaptotetrazole 0.5 g/Ag 100 g

Protective Layer: about 1μ:

Binder: Gelatin 1.7 g/m$^2$

Coating assistant: Sodium salt of N-oleyl-N-methyltaurine 7 mg/m$^2$

Hardening agent: Sodium salt of 2,4-dichloro-6-hydroxy-1,3,5-triazine 0.4 g/100 g gelatin Sample 11 was composed of only the above described compositions, and Samples 12 to 14 were composed of the above described compositions, but additionally the protective layer contained Compounds 3, 9 and 12 in amounts of 1.5 mg/m$^2$, respectively.

Additionally, for comparison, Sample 15 was prepared wherein 1.5 mg/m$^2$ of Comparative Compound (A) was added to the above described composition to form a protective layer.

Comparative Compound (A):

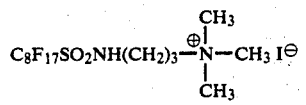

(A)

In order to evaluate the coating ability of these samples, the number of "repelling" spots in 1 square meter of the samples was counted (by the naked eye).

Further, after the unexposed samples were conditioned at 25° C. and 25% RH for 2 hours, they were subjected to friction by a rubber roller and a nylon roller in a dark room under the same conditioning condition as described above. Thereafter, they were developed with the following developing solution, fixed and washed with water, and the occurrence of static marks was examined.

| Composition of Developing Solution: | |
|---|---|
| Warm water | 800 ml |
| Sodium tetrapolyphosphate | 2.0 g |
| Anhydrous sodium sulfite | 50 g |
| Hydroquinone | 10 g |
| Sodium carbonate (monohydrate) | 40 g |
| 1-Phenyl-3-pyrazolidone | 0.3 g |
| Potassium bromide | 2.0 g |
| Water to make | 1,000 ml (pH 10.2) |

Results of examination of the antistatic property and the coating ability of these samples are shown in Table 1.

TABLE 1

| Sample No. | Antistatic Agent | Occurrence of Static Marks Rubber | Occurrence of Static Marks Nylon | Coating Ability (number of repelling spots/m$^2$) |
|---|---|---|---|---|
| 11 | None | D | D | 0 |
| 12 | Compound 3 | A | A | 0 |
| 13 | Compound 9 | A | A | 0 |
| 14 | Compound 12 | A | A | 0 |
| 15 | Comparative Compound (A) | B | C | 5 |

In Table 1, evaluation of the occurrence of static marks was carried out according to the following four stages:
A: The ocurrence of static marks was not observed.
B: The occurrence of static marks was slightly observed.
C: The occurrence of static marks was considerably observed.
D: The occurrence of static marks was observed on nearly the whole surface.

As is clear from Table 1, antistatic samples using the compounds of the present invention show excellent antistatic effects, by which the occurrence of static marks was hardly observed, and it is understood that they did not have any adverse influence upon the coating ability. On the contrary, in the control sample, the antistatic property was very poor. In Sample 15 used for comparison, the antistatic property was somewhat improved, but the coating ability deteriorated.

EXAMPLE 2

Samples 21, 22, 23, and 24 composed of a cellulose triacetate base, an antihalation layer, a red-sensitive layer, an intermediate layer, a green-sensitive layer, a yellow filter layer, a blue-sensitive layer and a protective layer which were superposed in this order were prepared by coating and drying according to conventional methods. The composition of each layer was as follows.

Antihalation Layer:
Binder: Gelatin 4.4 g/m$^2$
Hardening agent: 1,3-Bis(vinylsulfonyl)propanol-2 1.2 g/100 g binder
Coating assistant: Sodium dodecylbenzenesulfonate 4 mg/m$^2$
Antihalation component: Black colloidal silver 0.4 g/m$^2$ Red-Sensitive Layer:
Binder: Gelatin 7 g/m$^2$
Hardening agent: 1,3-Bis(vinylsulfonyl)propanol-2 1.2 g/100 g binder
Coating assistant: Sodium dodecylbenzenesulfonate 10 mg/m$^2$
Silver content coated: 3.1 g/m$^2$
Composition of silver halide: AgI 2 mol% and AgBr 98 mol%
Antifogging agent: 4-Hydroxy-6-methyl-1,3,3a,7-tetrazaindene 0.9 g/Ag 100 g
Coupler: 1-Hydroxy-4-(2-acetylphenyl)azo-N-[4-(2,4-di-tert-amylphenoxy)butyl]-2-naphthamide 38 g/Ag 100 g
Sensitizing dye: Pyridinium salt of anhydro-5,5'-dichloro-9-ethyl-3,3'-di(3-sulfopropyl)-thiacarbocyanine hydroxide 0.3 g/Ag 100 g Intermediate Layer:
Binder: Gelatin 2.6 g/m$^2$
Hardening agent: 1,3-Bis(vinylsulfonyl)propanol-2 1.2 g/100 g binder
Coating assistant: Sodium dodecylbenzenesulfonate 12 mg/m$^2$ Green-Sensitive Layer:
Binder: Gelatin 6.4 g/m$^2$
Hardening agent: 1,3-Bis(vinylsulfonyl)propanol-2 1.2 g/100 g binder
Coating assistant: Sodium dodecylbenzenesulfonate 9 mg/m$^2$
Silver content coated: 2.2 g/m$^2$
Composition of silver halide: AgI 3.3 mol% and AgBr 96.7 mol%
Stabilizer: 4-Hydroxy-6-methyl-1,3,3a,7-tetrazaindene 0.6 g/Ag 100 g
Coupler: 1-(2,4,6-Trichlorophenyl)-3-[3-(2,4-di-tert-amylphenoxy)acetamido]benzamido-4-(4-methoxyphenyl)azo-5-pyrazolone (37 g/Ag 100 g
Sensitizing dye: Pyridinium salt of anhydro-5,5'-diphenyl-9-ethyl-3,3'-di(2-sulfoethyl)oxacarbocyanine hydroxide 0.3 g/Ag 100 g Yellow Filter Layer:
Binder: Gelatin 2.3 g/m$^2$
Filter component: Yellow colloidal silver 0.7 g/m$^2$
Hardening agent: 1,3-Bis(vinylsulfonyl)propanol-2 1.2 g/100 g binder
Surface active agent: Sodium salt of 2-sulfonatosuccinic acid bis(2-ethylhexyl)ester 7 mg/m$^2$ Blue-Sensitive Layer:
Binder: Gelatin 7 g/m$^2$
Hardening agent: 1,3-Bis(vinylsulfonyl)propanol-2 1.2 g/100 binder
Coating assistant: Sodium dodecylbenzenesulfonate 8 mg/m$^2$ Silver content coated: 2.2 g/m$^2$ Composition of silver halide: AgI 3.3 mol% and AgBr 96.7 mol%

Stabilizer: 4-Hydroxy-6-methyl-1,3,3a,7-tetrazaindene 0.4 g/Ag 100 g

Coupler: 2'-Chloro-5'-[2-(2,4-di-tert-amylphenoxy)-butyramido]-α-(5,5'-dimethyl-2,4-dioxo-3-oxazolidinyl)-α-(4-methoxybenzoyl)acetanilide 45 g/Ag 100 g Protective Layer:

Binder: Gelatin 2 g/m$^2$

Hardening agent: 1,3-Bis(vinylsulfonyl)propanol-2 1.2 g/100 g binder

Coating assistant: Sodium dioctylsulfosuccinate 5 mg/m$^2$

Matting agent: Copolymer of methyl methacrylate and methacrylic acid (ratio of copolymerization: 6:4, average particle size: 2.5μ) 100 mg/m$^2$ Sample 21 was composed of only the above described compositions, and Samples 22, 23 and 24 were composed of the above described compositions, but additionally the protective layer contained Compounds 4 and 7 and Comparative Compound (A), respectively, in an amount of 6 mg/m$^2$. These samples were subjected to development processing by a conventional color development process, and the antistatic property and the coating ability were examined in the same manner as in Example 1. The results are shown in Table 2.

TABLE 2

| Sample No. | Antistatic Agent | Coating Ability (number of repelling spots/m$^2$) | Occurrence of Static Marks | |
|---|---|---|---|---|
| | | | Rubber | Delrin |
| 21 | None (control) | 0 | D | D |
| 22 | Compound 4 | 0 | A | A |
| 23 | Compound 7 | 0 | A | A |
| 24 | Comparative Compound (A) | 7 | B | B |

It is understood from Table 2 that in samples using the compounds of the present invention, the antistatic property was remarkably improved without deteriorating the coating ability.

On the other hand, when these samples were exposed to light according to JIS K 7614-1981 and thereafter subjected to color development processing, Sample 24 (using the comparative compound) exhibited significant desensitization in the blue, green, and red sensitive layers. However, in the case of using the compounds of the present invention, deterioration of the photographic properties was hardly observed.

EXAMPLE 3

Samples 31, 32, 33, 34 and 35 were prepared by coating and drying according to the conventional method, wherein a back layer and a protective layer for the back layer were applied to one side of a cellulose triacetate base and an antihalation layer, a red-sensitive layer, an intermediate layer, a green-sensitive layer, a yellow filter layer, a blue-sensitive layer, and a protective layer were applied in this order to the reverse side. The composition of each layer was as follows.

Back Layer:

Binder: Lime-treated gelatin 6.2 g/m$^2$

Salt: Potassium nitrate 0.1 g/m$^2$

Hardening agent: 1,3-Bis(vinylsulfonyl)propanol-2 0.6 g/100 g binder

Protective Layer for the Back Layer:

Binder: Lime-treated gelatin 2.2 g/m$^2$

Matting agent: Polymethyl methacrylate (average particle size: 2.5μ) 20 mg/m$^2$ Hardening agent: 1,3-Bis(vinylsulfonyl)propanol-2 1.2 g/100 g binder Coating assistant:

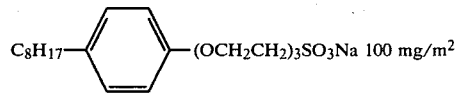

The antihalation layer and the other layers were the same as those in Example 2, and the protective layer was the same as that in Sample 22.

Sample 31 was composed of only the above described compositions. Sample 32 was composed of the above described compositions, except that Compound 1 of the present invention was added to the protective layer for the back layer in an amount of 1.5 mg/m$^2$. Sample 33 was composed of the same compositions except that the Compound 11 of the present invention was added in an amount of 3 mg/m$^2$. Sample 34 was composed of the same compositions, except that Compounds 2, 3, 4, 5, and 6 were added in amounts of 0.06, 1.5, 1.05, 0.15, and 0.15 mg/m$^2$, respectively. Further, sample 35 was produced as a comparative sample by adding compound (B)

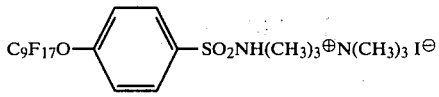

(B)

to the composition of Sample 31 so as to contain it in an amount of 3 mg/m$^2$ in the protective layer for the back layer.

The antistatic property and the coating ability of these samples were examined by the same manner as in Example 1, except that the back face thereof was subjected to friction by a rubber or Delrin roller. Results are shown in the following.

TABLE 3

| Sample No. | Antistatic Agent | Coating Ability (number of repelling spots/m$^2$) | Occurrence of Static Marks | |
|---|---|---|---|---|
| | | | Rubber | Delrin |
| 31 | None (control) | 0 | D | D |
| 32 | Compound 1 | 0 | A | A |
| 33 | Compound 11 | 0 | A | A |
| 34 | Compounds 2, 3, 4, 5, and 6 | 0 | A | A |
| 35 | Comparative Compound (B) | 10 | A | C |

It is understood from Table 3 that in samples using the compounds of the present invention, the antistatic property is remarkably improved without deteriorating the coating ability.

EXAMPLE 4

Samples 41 to 46 composed of a cellulose triacetate base, an antihalation layer, a red-sensitive layer, an intermediate layer, a green-sensitive layer, a yellow filter layer, and blue-sensitive layer each having the same composition as in Example 2 and a protective lower layer and a protective upper layer having the compositions indicated below, were produced by coating at 85 m/min and drying by a conventional method.

Protective Lower Layer:

Binder: Gelatin 1.6 g/m$^2$

Hardening agent: 1,3-Bis(vinylsulfonyl)propanol-2 1.2 g/100 g binder

Coating assistant: Sodium dioctylsulfosuccinate 5 mg/m$^2$

Ultraviolet ray absorbing agent:

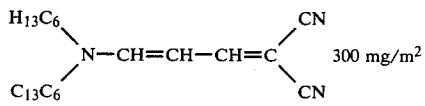

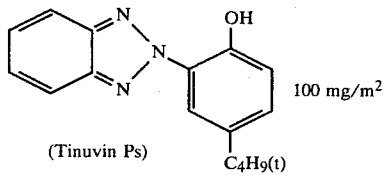

(Tinuvin Ps)

Protective Upper Layer:

Binder: Ossein acid treated gelatin (isoelectric point: 7) 1 g/m$^2$

Hardening agent: 1,3-Bis(vinylsulfonyl)propanol-2 1.2 g/100 g binder

Matting agent: Copolymer of methyl methacrylate and methacrylic acid (ratio of copolymerization: 5:5, average particle size: 3$\mu$) 30 mg/m$^2$ Polymethyl methacrylate (average paeticle size: 3$\mu$) 10 mg/m$^2$ Sample 41 was composed of only the above described compositions, and Samples 42, 43, 44 and 45 were composed of the above described compositions except that Compound 4 of the present invention or Comparative Composition (C)

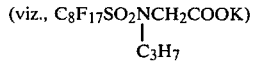

and a coating assistant were added to each, as indicated in Table 4 below. The coating ability and the antistatic property of these samples were examined in the same manner as in Example 2. The results are shown in Table 4.

TABLE 4

| Sample No. | Coating Assistant | | Antistatic Agent (mg/m$^2$) | | Coating Ability (number of repelling spots/m$^2$) | Occurrence of Static Marks | |
|---|---|---|---|---|---|---|---|
| | | | | | | Rubber | Delrin |
| 41 | Sodium dioctylsulfosuccinate | 80 mg/m$^2$ | None (control) | | 0 | D | D |
| 42 | Sodium dioctylsulfosuccinate | 7 | Compound 4 | 0.5 | 0 | A | A |
| 43 | Sodium dioctylsulfosuccinate | 80 | Compound 4 | 6 | 0 | A | A |
| 44 | Sodium dioctylsulfosuccinate | 200 | Compound 4 | 50 | 0 | A | A |
| 45 | Sodium dioctylsulfosuccinate | 30 | Comparative Compound (C) | 6 | 1 | D | B |
| 46 | Sodium dioctylsulfosuccinate | 30 | Comparative Compound (C) | 18 | 2 | B | D |

As is clear from Table 4, in samples using the compounds of the present invention, the antistatic property was remarkably improved without deteriorating the coating ability. On the contrary, the comparative compound did not satisfy the antistatic property to a Delrin roller and a rubber roller at the same time, even when the amount of it was varied. Further, in Samples 42 to 44, using a compound according to the present invention, wetting and spreading of the developing solution were excellent, and, consequently, uneven development or adhesion of bubbles to the film surface did not occur. However, in Sample 45 and, particularly in Sample 46, using the comparative compound, the wetting of the developing solution was inferior.

While the invention has been described in detail and with reference to specific embodiments thereof, it will be apparent to one skilled in the art that various changes and modifications can be made therein without departing from the spirit and scope thereof.

What is claimed is:

1. A light sensitive photographic element having at least a support and a silver halide emulsion layer wherein at least one layer of the element contains an antistatic compound represented by formula (I)

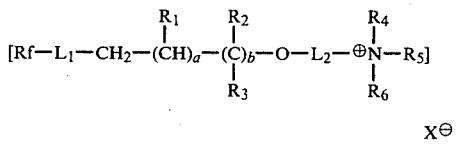

wherein Rf represents a saturated or unsaturated hydrocarbon group having from 3 to 20 carbon atoms wherein all or a part of the hydrogen atoms are substituted by fluorine atoms, each of $L_1$ and $L_2$ represents a divalent linking group, each of $R_1$, $R_2$, and $R_3$ represents a hydrogen atom, a methyl group, or an ethyl group, each of $R_4$, $R_5$, and $R_6$ represents an alkyl group having from 1 to 6 carbon atoms, X represents an anion, and each of a and b represents 0, 1, or 2, and wherein the concentration of the compound represented by formula (I) is at least 0.0001 grams per square meter of the photographic sensitive material.

2. A silver halide photographic sensitive element as in claim 1, wherein the compound represented by formula (I) is present in a layer other than a silver halide emulsion layer.

3. A silver halide photographic sensitive element as in claim 1, wherein the compound represented by formula (I) is present in at least one layer selected from a surface protective layer, a back layer, an intermediate layer, and a subbing layer.

4. A silver halide photographic sensitive element as in claim 1, wherein the compound represented by formula (I) is present in at least one of a surface protective layer and a back layer.

5. A silver halide photographic sensitive element as in claim 1, 2, 3, or 4, wherein the concentration of compound represented by formula (I) is from 0.0001 to 2.0 g/m$^2$ of the photographic sensitive material.

6. A silver halide photographic sensitive element as in claim 1, 2, 3, or 4, wherein the concentration of compound represented by formula (I) is from 0.0005 to 0.05 g/m$^2$ of the photographic sensitive material.

* * * * *